US009617833B2

(12) United States Patent
Madasu et al.

(10) Patent No.: US 9,617,833 B2
(45) Date of Patent: Apr. 11, 2017

(54) EVALUATING FLUID FLOW IN A WELLBORE

(75) Inventors: Srinath Madasu, Houston, TX (US); Samuel Bryant Johnson, Spring, TX (US); Jie Bai, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 971 days.

(21) Appl. No.: 13/530,898

(22) Filed: Jun. 22, 2012

(65) Prior Publication Data

US 2013/0346035 A1 Dec. 26, 2013

(51) Int. Cl.

| | |
|---|---|
| ***E21B 43/00*** | (2006.01) |
| ***E21B 47/10*** | (2012.01) |
| *G06F 17/11* | (2006.01) |
| *G06F 17/12* | (2006.01) |

(52) U.S. Cl.

CPC ..... *E21B 43/00* (2013.01); *E21B 47/10* (2013.01)

(58) Field of Classification Search

CPC .. G06F 17/5009; G06F 17/5018; G06F 17/11; G06F 17/12; E21B 49/003; E21B 43/00

USPC ..... 703/2, 10

See application file for complete search history.

(56) References Cited

U.S. PATENT DOCUMENTS

| | | | | |
|---|---|---|---|---|
| 7,925,482 | B2 | 4/2011 | Kennon et al. | |
| 2008/0091396 | A1 | 4/2008 | Kennon et al. | |
| 2009/0308601 | A1* | 12/2009 | Poe, Jr. | E21B 47/06 166/250.01 |
| 2010/0082258 | A1 | 4/2010 | Wang | |
| 2011/0040485 | A1* | 2/2011 | Ong | E21B 47/10 702/12 |
| 2011/0040536 | A1* | 2/2011 | Levitan | E21B 49/00 703/2 |
| 2013/0080128 | A1* | 3/2013 | Yang | G06F 17/5009 703/2 |

OTHER PUBLICATIONS

Carvajal et al. "Holistic Automated Workflows for Reservoir and Production Optimization", SPE 130205, SPE EUROPEC/EAGE Annual Conference and Exhibition held in Barcelona, Spain, Jun. 14-17, 2010, pp. 1-12.*

(Continued)

*Primary Examiner* — Omar Fernandez Rivas
*Assistant Examiner* — Shiuh-Huei Ku
(74) *Attorney, Agent, or Firm* — John W. Wustenberg; Parker Justiss, P.C.

(57) ABSTRACT

Techniques for evaluating a fluid flow through a wellbore include identifying an input characterizing a fluid flow through a wellbore; identifying an input characterizing a geometry of the wellbore; generating a model of the wellbore based on the inputs characterizing the fluid flow and the geometry of the wellbore; simulating the fluid flow through the wellbore based on evaluating the model with a numerical method that determines fluid flow conditions at a first boundary location uphole and adjacent to a perforation of a plurality of perforations in the wellbore and at a second boundary location downhole and adjacent to the perforation; and preparing, based on the fluid flow conditions determined with the numerical method, an output associated with the simulated fluid flow through the wellbore for display to a user.

31 Claims, 4 Drawing Sheets

(56) References Cited

OTHER PUBLICATIONS

Authorized Officer Adri Schouten, PCT International Search Report and Written Opinion of the International Searching Authority, PCT/US2013/047033, 10 pages.
Schlumberger, ECLIPSE Multisegmented Well Model, http://www.slb.com/services/software/reseng/eclipse_options/multi_segmented_well_model.aspx, last viewed on Jun. 20, 2012.
Ouyang et al., "A Single-Phase Wellbore-Flow Model for Horizontal, Vertical, and Slanted Wells," SPE Journal, Jun. 1998, pp. 124-133.
Vicente et al., "A Numerical Model Coupling Reservoir and Horizontal Well-Flow Dynamics: transient behavior of Single-Phase Liquid and Gas Flow," SPE Journal, Mar. 2002, pp. 70-77.
Anklam et al., "A review of Horizontal Wellbore Pressure Equations," SPE 94314, 2005 SPE Production and Operations Symposium, Apr. 17-19, 2005 (7 pages).
Novy, R.A., "Pressure Drops in Horizontal Wells: When Can They Be ignored," SPE Reservoir Engineering, Feb. 1995, pp. 29-35.
Halliburton, INSITE® for Well Intervention (IWI™) Software, copyright 2010 (13 pages).
Halliburton, StimWatch® Stimulation Monitoring Service, Jun. 2010 (4 pages).
PCT International Preliminary Report on Patentability, PCT/US2013/047033, Dec. 31, 2014, 8 pages.

* cited by examiner

EVALUATING FLUID FLOW IN A WELLBORE

BACKGROUND

In the petroleum industry, hydrocarbon fluids are produced by wells drilled into offshore or land-based reservoirs. The wells range in geometry (e.g., depth and length from a few hundred meters to several kilometers) and designs (completions), which are used for different situations found in offshore and land-based hydrocarbon reservoirs, respectively. The complexity of wellbore design has increased with time, as new techniques are found to produce oil and gas reservoirs. Concurrently, there is a need to assess flow within a wellbore.

DETAILED DESCRIPTION

Figure 1:
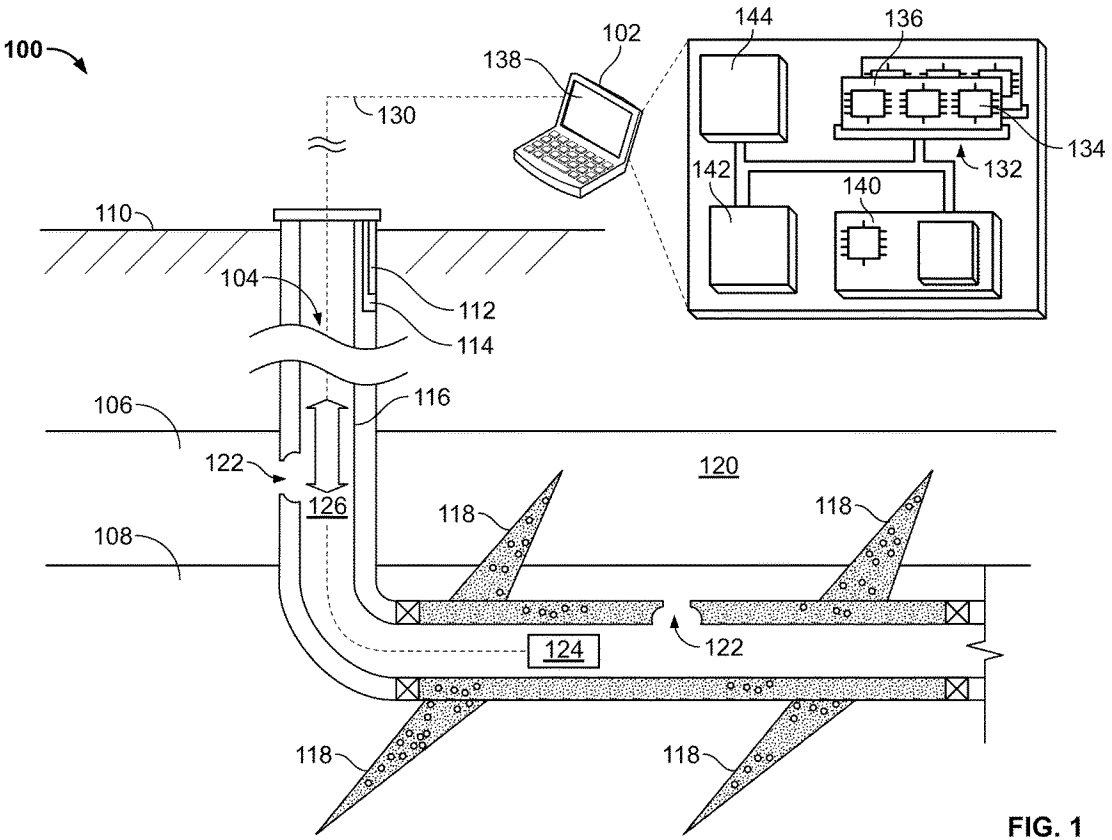
FIG. 1 illustrates an example well system including an example embodiment of a fluid modeling engine for modeling a flow of fluid through a wellbore.

This disclosure describes example implementations of systems, methods, apparatus, and computer-readable media for evaluating a fluid flow through a wellbore by identifying an input characterizing a fluid flow through a wellbore; identifying an input characterizing a geometry of the wellbore; generating a model of the wellbore based on the inputs characterizing the fluid flow and the geometry of the wellbore; simulating the fluid flow through the wellbore based on evaluating the model with a numerical method that determines fluid flow conditions at a first boundary location uphole and adjacent to a perforation of a plurality of perforations in the wellbore and at a second boundary location downhole and adjacent to the perforation; and preparing, based on the fluid flow conditions determined with the numerical method, an output associated with the simulated fluid flow through the wellbore for display to a user.

In a first aspect combinable with any of the example implementations, the numerical method comprises a discontinuous Galerkin numerical method.

In a second aspect combinable with any of the previous aspects, simulating the fluid flow through the wellbore based on evaluating the model with a numerical method includes discretizing a conservation of mass equation.

In a third aspect combinable with any of the previous aspects, simulating the fluid flow through the wellbore based on evaluating the model with a numerical method includes applying a penalty term to the discretized conservation of mass equation based on a divergence of a fluid velocity of the fluid flow in the wellbore.

In a fourth aspect combinable with any of the previous aspects, the penalty term comprises the equation. $\nabla\cdot u-(\epsilon)^*(\nabla\cdot(\nabla p-\rho g))=0$, where u is fluid momentum, $\rho$ is the density of the fluid, $\epsilon$ is a penalty parameter, p is pressure of the fluid, and g is acceleration due to the force of gravity.

In a fifth aspect combinable with any of the previous aspects, simulating the fluid flow through the wellbore based on evaluating the model with a numerical method includes determining a mass flow rate of the fluid that flows through the plurality of perforations of the wellbore based, at least in part, on a respective size of each of the plurality of perforations, a density of the fluid, and a pressure difference between a wellbore pressure and a reservoir pressure in a subterranean zone.

In a sixth aspect combinable with any of the previous aspects, determining a mass flow rate of the fluid that flows through the plurality of perforations of the wellbore based, at least in part, on a respective area of each of the plurality of perforations, a density of the fluid, and a pressure difference between a wellbore pressure and a reservoir pressure in a subterranean zone includes solving the equation: $\dot{M}_D=C_D A_D N_D \sqrt{\rho^*(P_W-P_R-P_f)}$, where $\dot{M}_D$ is the mass flow rate of the fluid that flows through the plurality of perforations of the wellbore, $C_D$ is a discharge coefficient, $A_D$ is a discontinuity area, p is the density of the fluid, $P_W$ is the wellbore pressure, $P_R$ is the reservoir pressure in the subterranean zone, and $P_f$ is a friction pressure.

In a seventh aspect combinable with any of the previous aspects, simulating the fluid flow through the wellbore based on evaluating the model with a numerical method includes determining a fluid pressure and a fluid velocity of the fluid flow at the plurality of perforations.

In an eighth aspect combinable with any of the previous aspects, generating a model of the wellbore based on the inputs characterizing the fluid flow and the geometry of the wellbore includes generating a one-dimensional mesh model of the wellbore based on the inputs characterizing the fluid flow and the geometry of the wellbore.

In a ninth aspect combinable with any of the previous aspects, the input characterizing the geometry of the wellbore includes at least one of a tubular diameter, a depth, and a location of the perforation.

In a tenth aspect combinable with any of the previous aspects, the input characterizing a fluid flow includes one of a pumping schedule that defines a fluid volumetric flow rate over time, a fluid density, and a fluid viscosity circulated from the terranean surface into the wellbore, or a production schedule that defines a fluid volumetric flow rate over time, a fluid density, and a fluid viscosity produced from a subterranean zone to the terranean surface.

In an eleventh aspect combinable with any of the previous aspects, the output comprises a bottom hole pressure and an amount of the fluid flowing through the one or more discontinuities.

Various embodiments of fluid flow assessment within the wellbore according to the present disclosure may have one or more of the following advantages. For example, a model of the fluid flow within the wellbore can improve the stability and accuracy of results with both global and local flux conservations. The model can account for discontinuities in velocity at the perforations and in the wellbore geometry that affect fluid velocity and pressure because of area changes. The model predicts both injection and production stage flows in the wellbore. The fluid loss at the perforations is computed based on modified orifice equation rather than a specified flow loss percentage.

These general and specific aspects can be implemented using a device, system or method, or any combinations of devices, systems, or methods. For example, a system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions. The details of one or more implementations are set forth in the accompanying drawings and the description below. Other features, objects, and advantages will be apparent from the description and drawings, and from the claims.

FIG. 1 illustrates an example well system 100 including an example embodiment of a fluid modeling engine 102 for modeling a flow of fluid through a wellbore 104. The well system 100 can include one or more additional production wells (not shown in the FIG. 1). In some example embodiments, and described in more detail below, the fluid modeling engine 102 may generate, calibrate, re-calibrate, and otherwise evaluate a fluid flow model of fluid through a wellbore between a subterranean zone and a terranean surface based on collected geometrical data of the wellbore and flow characteristic data (e.g., a pumping schedule for a wellbore fluid such as a fracturing fluid or a flow of production hydrocarbons, or other fluid flow). In some embodiments, the fluid flow modeling engine 102 may calibrate and/or re-calibrate, for example, the pumping schedule based on the output data. Such a fluid flow model may, in some embodiments, allow a well operator to determine and/or predict the efficiency of pumping through a wellbore. For instance, the well operator, driller, or well owner, for example, may determine the fluid flow and the fluid loss in several regions of the wellbore and compare them to standard, predicted, and/or expected values.

FIG. 1 illustrates a portion of an example embodiment of the wellbore system 104 according to the present disclosure. Generally, the wellbore 104 accesses one or more subterranean formations 106 and/or 108, and facilitates production of any hydrocarbons located in such subterranean formations 106 and/or 108 (or other subterranean formations or zones).

As illustrated in FIG. 1, the well system 100 includes a wellbore 104 formed with a drilling assembly (not shown) deployed on a terranean surface 110. The drilling assembly may be used to form a vertical wellbore portion extending from the terranean surface 110 and through one or more subterranean formations 106, 108 in the Earth. The subterranean region may include a reservoir 120 that contains hydrocarbon resources, such as oil, natural gas, and/or others. The reservoir 120 may include porous and permeable rock containing liquid and/or gaseous hydrocarbons. The reservoir 120 may include a conventional reservoir, a non-conventional reservoir, a tight gas reservoir, and/or other types of reservoir. The well system 100 produces the resident hydrocarbon resources from the reservoir 120 to the surface 110 through the wellbore 104.

The wellbore 104 may extend through a hydrocarbon-containing subterranean formation area and into a water-bearing area. The water-bearing area may include, for example, fresh water, saltwater (e.g., water containing one or more salts dissolved therein), brine (e.g., saturated saltwater), and/or similar fluids. Typically, the water-bearing area may include a small proportion of hydrocarbon and/or other materials, the hydrocarbon-bearing area may include a small proportion of water and/or other materials, and the areas may overlaps in an intermediate area containing varying proportions of water and hydrocarbons. In some implementations, the water may come from a variety of sources, including in-situ water, injected water, or water entering the reservoir from an external source. For example, the water may be introduced into the formation through the injection well 104.

In some embodiments, the drilling assembly may be deployed on a body of water rather than the terranean surface 110. For instance, in some embodiments, the terranean surface 110 may be an ocean, gulf, sea, or any other body of water under which hydrocarbon-bearing formations may be found. In short, reference to the terranean surface 110 includes both land and water surfaces and contemplates forming and/or developing one or more wellbores 104 from either or both locations.

The wellbore 104 in the well system 100 may include any combination of horizontal, vertical, slant, curved, articulated, lateral, multi-lateral and/or other well bore geometries. One or more wellbore casings, such as a conductor casing 112, an intermediate casing 114, and a production casing 116 may be installed in at least a portion of the vertical portion of the wellbore 104 and/or other wellbore portion. Alternatively, in some embodiments, one or more of the casings 112, 114, and 116 may not be installed (e.g., an open hole completion).

In some embodiments, the wellbore 104 may include multiple discontinuities (e.g. perforations, fractures, or other discontinuities). FIG. 1 illustrates exemplary discontinuities 122 and fractures 118. The discontinuities 122 may include a communication tunnel created from the casing 116 into the reservoir formation 120, through which oil or gas is produced. The geometry of the perforation 122 may depend on the method used to create the perforation 122. In some embodiments, discontinuities are created with jet perforating guns equipped with shaped explosive charges, bullet perforating, abrasive jetting or high-pressure fluid jetting and/or perforating methods.

The reservoir 120 includes multiple subterranean fractures 118 in fluid communication with the production well 104. The fractures 118 may include fractures formed by a fracture treatment applied through the production well 104, natural fractures, complex fractures, and/or a network of propagated and natural fractures. For example, in addition to the bi-wing fractures shown in FIG. 1, the reservoir 120 may include a complex fracture network with multiple connected fractures at multiple orientations. The fractures 118 may extend at any angle, orientation, and azimuth from the wellbore 104. The fractures 118 include transverse fractures, longitudinal fractures (e.g., curtain wall fractures), and/or deviated fractures that extend along natural fracture lines. Hydraulically propagated fractures may have a geometry, size and/or orientation determined by injection tool settings.

The fractures 118 may contain proppant material injected into the fractures 118 to hold the fractures 118 open for resource production. Fluids typically flow more readily through the fractures 118 than through the rock and/or other geological material surrounding the fractures 118. For example, in some instances, the permeability of the rock in the reservoir 120 may be several orders of magnitude less than the permeability in the fractures 118.

As illustrated in FIG. 1, a single detector 124 (or multiple detectors) may be inserted into the wellbore 104 and communicably coupled to a computing system 102 through, for example, a wireline 130. In some embodiments, the detector(s) 124 also includes logging capabilities (e.g., a MWD or LWD tool) to evaluate and/or measure physical properties of the subterranean zones 106 and/or 108, including pressure, temperature, and wellbore trajectory in three-dimensional space. The measurements may be made downhole, stored in solid-state memory for some time, and later transmitted to the computing system 102 (e.g., for storage and/or analysis). In some embodiments, the logging tool within the detector 124 may measure fluid flow parameters (e.g., velocity, rate, pressure). Such physical properties may be transmitted and/or transferred (e.g., over the network 130) to the computing system 102 for storage in memory 132. For example, as illustrated, such properties may be stored as data properties 134 in the illustrated memory 132.

Alternatively, data properties 134 may be transmitted from the detector 124 through other techniques, such as, for example, fiber optic cable, wireless communication (e.g., WiFi, cellular, Bluetooth, RF, or otherwise), coaxial cable, or other form of data communication technique. Moreover, in some implementations, data properties 134 may comprise historical data of the wellbore 104 that have been measured previously and stored in the illustrated memory 132. Data properties 134 may also include data of similar, although not identical, wellbores that have been previously formed and logged in a similar geologic formation.

The illustrated computing system 102 includes the memory 132, a graphical user interface (GUI) 138, an interface 140, a processor 142, and the fluid flow engine 144. Although illustrated as a single computer, the computing system 102 may be, for example, a distributed client-server environment, multiple computers, or a stand-alone computing device, as appropriate. For example, in some embodiment, the computer 102 may comprise a server that stores one or more applications (e.g., the wellbore fluid flow engine 144) and application data. In some instances, the computer 102 may comprise a web server, where the applications represent one or more web-based applications accessed and executed via a network by one or more clients (not shown).

At a high level, the computer 102 comprises an electronic computing device operable to receive, transmit, process, store, or manage data and information associated with the computing system 102. Specifically, the computer 102 may receive application requests from one or more client applications associated with clients of the system 102 and respond to the received requests by processing said requests in the fluid flow engine 144, and sending the appropriate response from the wellbore fluid flow engine 144 back to the requesting client application. Alternatively, the computer 102 may be a client device (e.g., personal computer, laptop computer, PDA, tablet, smartphone, cell phone, other mobile device, or other client computing device) that is communicably coupled to a server or server pool (not shown).

As used in the present disclosure, the term "computer" is intended to encompass any suitable processing device. For example, although FIG. 1 illustrates a single computer 102, the system 102 can be implemented using two or more servers, as well as computers other than servers, including a server pool. Indeed, computer 102 may be any computer or processing device such as, for example, a blade server, general-purpose personal computer (PC), Macintosh, workstation, UNIX-based workstation, or any other suitable device. In other words, the present disclosure contemplates computers other than general purpose computers, as well as computers without conventional operating systems. Further, illustrated computer 102 may be adapted to execute any operating system, including Linux, UNIX, Windows, Mac OS, or any other suitable operating system.

Even though FIG. 1 illustrates a single processor 142, two or more processors may be used according to particular needs, desires, or particular embodiments of the computer 102. Each processor 142 may be a central processing unit (CPU), a blade, an application specific integrated circuit (ASIC), a field-programmable gate array (FPGA), or another suitable component. Generally, the processor 142 executes instructions and manipulates data to perform the operations of computer 102 and, specifically, the wellbore fluid flow engine 144. Specifically, the processor 142 executes the reception and response to requests, as well as the functionality required to perform the operations of the software of wellbore fluid flow engine 144.

Regardless of the particular implementation, "software" may include computer-readable instructions, firmware, wired or programmed hardware, or any combination thereof on a tangible medium operable when executed to perform at least the processes and operations described herein. Indeed, each software component may be fully or partially written or described in any appropriate computer language including C, C++, Java, Visual Basic, assembler, Perl, any suitable version of 4GL, as well as others. It will be understood that while portions of the software illustrated in FIG. 1 are shown as individual modules that implement the various features and functionality through various objects, methods, or other processes, the software may instead include a number of sub-modules, third party services, components, libraries, and such, as appropriate. Conversely, the features and functionality of various components can be combined into single components as appropriate.

At a high level, the wellbore fluid flow engine 144 is any application, program, module, process, or other software that may execute, change, delete, generate, or otherwise manage information according to the present disclosure, particularly in response to and in connection with one or more requests received from, for example, a user of the computer 102 or other client devices. For example, the engine can generate a model based on fluid flow characteristics and wellbore geometry and evaluate the model to determine multiple parameters related to fluid flow characteristics (e.g., fluid loss through one or more discontinuities). In certain cases, the system 100 may implement a composite wellbore fluid flow engine 144. For example, portions of the wellbore fluid flow engine 144 may be implemented as Enterprise Java Beans (EJBs) or design-time components that have the ability to generate run-time implementations into different platforms, such as J2EE (Java 2 Platform, Enterprise Edition) or Microsoft's .NET, among others.

Additionally, the wellbore fluid flow engine 144 may represent a web-based application accessed and executed by remote clients or client applications via a network (e.g., through the Internet). Further, while illustrated as internal to computer 102, one or more processes associated with the wellbore fluid flow engine 144 may be stored, referenced, or executed remotely. For example, a portion of the wellbore fluid flow engine 144 may be a web service associated with the application that is remotely called, while another portion of the wellbore fluid flow engine 144 may be an interface object or agent bundled for processing at a remote client. Moreover, any or entire wellbore fluid flow engine 144 may be a child or sub-module of another software module or enterprise application (not illustrated) without departing from the scope of this disclosure.

The illustrated computer 102 also includes memory 132. Memory 132 may include any memory or database module and may take the form of volatile or non-volatile memory including, without limitation, magnetic media, optical media, random access memory (RAM), read-only memory (ROM), removable media, or any other suitable local or remote memory component. Memory 132 may store various objects or data, and any other appropriate information including any parameters, variables, algorithms, instructions, rules, constraints, or references thereto associated with the purposes of the computer 102 and the wellbore fluid flow engine 144. For example, the memory 132 may store flow data 134 gathered and/or measured by the detector 124. Further, the memory 132 may store one or more flow models 136 generated, derived, and/or developed based on the input data received from a user of the computing system 102 and/or detector 124. For example, a particular flow model 136 may describe flow properties (e.g., velocity, rate, profile, and other properties) in a particular portion of the wellbore corresponding to all or a part of a subterranean zone 106 or 108.

The GUI 138 comprises a graphical user interface operable to interface with at least a portion of the system 102 for any suitable purpose, including generating a visual representation of the fluid flow 126 through the wellbore 104 (in some instances, the web browser) and the interactions with the detector 124, for example, graphical or numerical representations of the flow data and/or the flow models 136. Generally, through the GUI 138, the user is provided with an efficient and user-friendly presentation of data provided by or communicated within the system. The term "graphical user interface," or GUI 138, may be used in the singular or the plural to describe one or more graphical user interfaces and each of the displays of a particular graphical user interface. Therefore, the GUI 138 can represent any graphical user interface, including but not limited to, a web browser, touch screen, or command line interface (CLI) that processes information in the system 102 and efficiently presents the information results to the user.

The computer 102 may communicate, e.g., with a detector 124 through the wireline 130, and/or with one or more other systems or computers within a network, or with one or more other computers or systems via the Internet, through an interface 140. The interface 140 is used by the computing system 102 for communicating with other systems in a client-server or other distributed environment (including within system 102) connected to a network. Generally, the interface 140 comprises logic encoded in software and/or hardware in a suitable combination and operable to communicate with a network. More specifically, the interface 140 may comprise software supporting one or more communication protocols associated with communications such that a network or interface's hardware is operable to communicate physical signals within and outside of the illustrated system 102.

Figure 2:
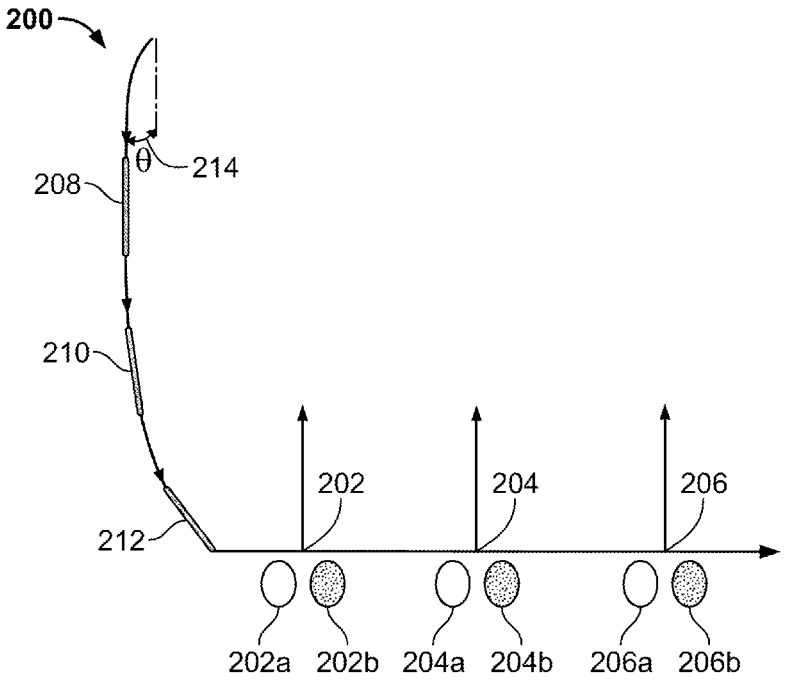
FIG. 2 illustrates an example method for modeling a flow of fluid through a wellbore that includes multiple discontinuities.

FIG. 2 illustrates an example model 200 of fluid flow through a wellbore that includes one or more discontinuities (e.g., perforations). In some embodiments, the fluid flow model 200 can be a one-dimensional numeric wellbore fluid flow simulator using a numerical method, for example the Discontinuous Galerkin (DG) method. The fluid flow model 200 may, but will not necessarily, account for the following features: compressible flow, incompressible flow, Newtonian flow, non-Newtonian flow, sources and sinks for interaction with the reservoir flow. In some embodiments of the fluid flow model 200, flow discontinuities arise at the perforation points (202, 204 and 206) due to singularities in stress and infinite velocity gradients. In FIG. 2, three discontinuities are illustrated, however the fluid flow model 200 can include more or less discontinuities, depending on the wellbore characteristics.

Flow discontinuities may be resolved, e.g., by the flow engine 144, using upstream (202*a*, 204*a* and 206*a*) and downstream (202*b*, 204*b* and 206*b*) nodes that arise at the discontinuities (e.g., perforations or otherwise). In some embodiments, the fluid flow model 200 can use an implicit or explicit solution, and may use parallel or serial execution. The inlet velocity to the wellbore is a prescribed value obtained from known fluid flow data (e.g., a pumping schedule). The desired velocity at the bottom hole may be substantially zero, because all the fluid is lost in the discontinuities. At the first perforation 202, the pressure at the upstream node (202*a*) is set equal to the pressure at the downstream node (202*b*) since the pressure is continuous at the discontinuities even though the discontinuity in velocity exists. The velocity at the downstream node 202*b* of the perforation 202 can be computed by the mass balance equation obtained by balancing the flow entering the perforation and flow loss at the perforation to the reservoir. The flow loss can be due to the pressure differential across the wellbore and reservoir.

The engine 144 may derive the flow loss from an adapted orifice equation, which accounts for frictional losses in the momentum balance. The adapted orifice equation enables the prediction of the flow at all ranges of pressure drops across the wellbore and the reservoir. In some embodiments, the adapted orifice equation couples the wellbore and the reservoir models. The momentum flux at the upstream node 202*a* is a function of the upstream node variables. Similarly, the mass flux at the downstream node 202*b* is a function of the downstream node variables. The mass (M) balance at the perforation is given as follows:

$$M_{flow\ rate\ at\ the\ downstream\ node} = M_{flow\ rate\ at\ the\ upstream\ node} - M_{flow\ rate\ loss}$$

In some embodiments, the mass flow rate loss ($M_{flow\ rate\ loss}$) can be described as:

$$M_{flowrateloss} = C_D A_P A_P \sqrt{(P_w - P_{res} - \text{frictionpressure})},$$

where $C_D$ is the discharge coefficient, $A_p$ is the perforation area, $N_p$ is the number of discontinuities, p is the density of the fluid, $P_w$ is the well pressure, $P_{res}$ is the reservoir pressure.

Similarly, the boundary conditions for pressure and velocity are computed at the other discontinuities except for the last perforation. At the last perforation 206, the pressure at the upstream node 206*a* is still set equal to the pressure at the downstream node 206*b*. The pressure at the downstream node may be computed from the mass balance equation shown above from the reservoir pressure and known mass flow rate (e.g., from a pumping schedule). This pressure may set the reference pressure for the wellbore calculations. The momentum flux at the upstream 206*a* and downstream 206*b* nodes is a function of the respective node variables. In some embodiments the pressure and velocity can be calculated for sections (e.g., 208, 210 and 212) of the wellbore, including geometrical characteristics, such as the inclination angle 214.

Figure 3:
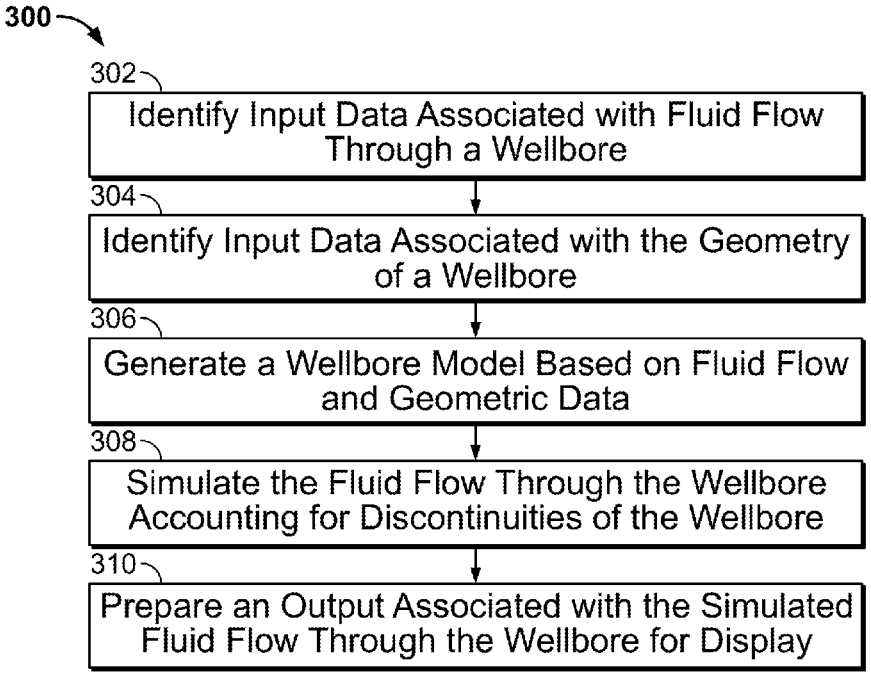
FIG. 3 illustrates an example method for analyzing fluid flow in a wellbore.

FIG. 3 illustrates an example method 300 for modeling fluid flow within a wellbore, such as the wellbore 104. In some embodiments, all or a portion of the method 300 may be performed with the wellbore fluid flow engine 144 illustrated in FIG. 1. Method 300 may begin at step 302, when fluid flow data associated with one or more subterranean zones or formations may be identified. In some embodiments, the identified fluid flow data may be previously stored (e.g., in memory 132) and may represent historical data associated with, for example, the particular field, formation, or wellbore. As another example, the identified fluid flow data can be real-time (e.g., between less than a second and several seconds) or near real-time (e.g., between several seconds and several minutes) data measured and/or determined by a detector (e.g., 124 in FIG. 1). In some embodiments, the input characterizing a fluid flow also includes the pumping schedule that defines a fluid volumetric flow rate over time, the fluid density, and fluid viscosity circulated from the subterranean regions into the wellbore. In some embodiments, the input characterizing a fluid flow can include the production schedule that defines, for example, the fluid volumetric flow rate over time, the fluid density, and the fluid viscosity produced from a subterranean zone (e.g., 106 and/or 108 in FIG. 1) to the terranean surface (e.g., 110 in FIG. 1).

In step 304, the wellbore geometry may be identified. In some embodiments the wellbore geometry can include global or local values describing simple or complex geometries. The input characterizing the geometry of the wellbore can include, for example, values of the tubular diameters, depth, and the location of discontinuities (e.g., perforations, fractures, or other discontinuities).

In step 306, the wellbore fluid flow engine (and/or another application) may generate a wellbore model based on fluid flow and geometric data. The generated wellbore model may be represented graphically, numerically, textually, or combination thereof. For example, the wellbore model may consist of a conceptual, three-dimensional construction of a formation, a portion of a formation, or a whole field for instance. The model may be constructed from incomplete data with some data estimated from, for example, nearby wells or from low vertical resolution data.

In some embodiments, the wellbore model can be one-dimensional. The generation of the wellbore model can be designed to simulate unsteady, single-phase compressible flow with cross sectional area changes taken into consideration. In some embodiments, the wellbore model can include the computation of mass and momentum conservation equations for single phase. The wellbore model may be strongly coupled to the reservoir through the pressure drop across the perforation, thereby predicting the delivery of the fracturing fluid to the reservoir and hence, it should be solved fully implicitly together with the reservoir.

In step 308, the wellbore fluid flow engine 144 within the computing system 102 (illustrated in FIG. 1) simulates the wellbore model. The simulation of the fluid flow through the wellbore can be based on a numerical method that accounts for one or more discontinuities of the wellbore. In some embodiments, the simulation of the wellbore model implies discretization of the conservation of mass equation and the implementation of a penalty term to the discretized conservation of mass equation based on a divergence of the fluid velocity of the fluid flow.

In some embodiments the flow though a wellbore can be determined using a numerical method. Thus the wellbore model can include discontinuous Galerkin numerical method, finite difference method or other numerical methods. In some embodiments the numerical method used by the wellbore model is a Discontinuous Galerkin Finite Element method (DGFEM), combining the features of both finite volume and finite element methods to offer stability and accuracy of results with both global and local flux conservations. The wellbore model can handle discontinuities in velocity and pressure that occur because of area changes and multiple injection points to the fractures formation (as illustrated by FIG. 2).

For example, if $\phi_i$ is a weighting function and basis function, then a mass conservation residual is $$\int_{dn} \phi_i\left(\frac{\partial \rho}{\partial t} + \frac{\partial \rho v}{\partial \eta}\right)\partial \eta = 0.$$

In some embodiments, the velocity v and the pressure p can include values corresponding to multiple (n) sections of the wellbore (for example 208, 210 and 212 in FIG. 2):

$$v = \sum_{i=1}^{n} v_i \phi_i$$

$$p = \sum_{i=1}^{n} p_i \phi_i.$$

In some embodiments of step 308, the mass conservation equation (describing the physical coordinates) can be integrated by parts.

$$\int_{d\eta}\left[\phi_i\left(\frac{\partial \rho}{\partial t}\right) - \left(\frac{\partial \phi_i}{\partial \eta}\right)\rho v\right]d\eta + \phi_i \rho v|_0^2 = 0.$$

Step 308 can also include isoparametric mapping of the residuals from physical coordinates to computational coordinates to simplify the book keeping by using the same basis functions for every element (e.g., each section of the wellbore model).

$$\eta = \eta_i + \xi \Delta\eta$$

The mass conservation equation written in computational coordinates is:

$$\int_{d\xi}\left[\phi_i\left(\frac{\partial \rho}{\partial t}\right) - \left(\frac{\partial \phi_i}{\partial \xi}\right)\rho v\right]\frac{d\eta}{d\xi} + \phi_i \rho v|_0^2 = 0,$$

where $$\frac{\partial \eta}{\partial \xi} = \Delta\eta$$

represents the Jacobian of the transformation from physical to computational coordinates.

In some embodiments of step 308, the basis functions are the Lagrange shape functions or any other type of functions that can describe complicated geometries. The basis functions can have the following properties: quasi-orthogonality, spanning over two elements, error can be reduced by increasing the order of the basis function, and the order of basis functions can be determined from case to case.

In some embodiments of step 308, Gaussian quadrature is used to integrate the residual equations.

$$I = \int_a^b f(\zeta)d\zeta = w_0 f(\zeta_0) + w_1 f(\zeta_1) + \ldots\ w_n f(\zeta_n), \text{ and}$$

$$a < \zeta_0 < \zeta_1 < \ldots\ \zeta_b < b,$$

where $w_0$, $w_1$, . . . $w_n$ are the Gauss weights and $\zeta_0$, $\zeta_1$, . . . $\zeta_b$ are the Gauss points.

Step 308 may further utilize the selection of a set of boundary conditions. For example, boundary conditions can be Dirichlet type boundary conditions, where the value of a variable is known at a node allowing the replacement of the equation for that node with a predefined value. The selection of the boundary conditions also defines the matrix structure. For example, in the case of Dirichlet type boundary condition, the matrix structure is sparse and diagonally structured, which adds stability to the system.

In some embodiments of step 308, the continuity equation is penalized by adding a correction term to the divergence of the velocity. The correction term is computed by taking the divergence of the momentum (∇u) equation as follows: ∇u=0, which leads to:

$$\nabla\cdot u-\epsilon(\nabla\cdot(\nabla\cdot\rho v^2+\nabla p+\nabla\cdot\tau-\rho g))=0$$

For incompressible flows and constant cross-sectional area, the continuity equation reduces to:

$$\nabla\cdot u-(\epsilon)^*(\nabla\cdot(\nabla p-\rho g))=0,$$

where u is fluid momentum, ρ is the density of the fluid, g is the gravity, and ϵ is the penalty constant and p is pressure of the fluid.

In some embodiments, the wellbore model simulation 308 can include the calculation of pressure across discontinuities for small flow rates, which can include or ignore frictional losses.

At step 310, the simulator transforms input data that describes initial fluid flow and geometrical properties to generate output data that describes subsequent fluid flow properties. The same and/or different types of computer software and/or hardware may be used to display these and/or other features of a wellbore fluid flow.

Figure 4:
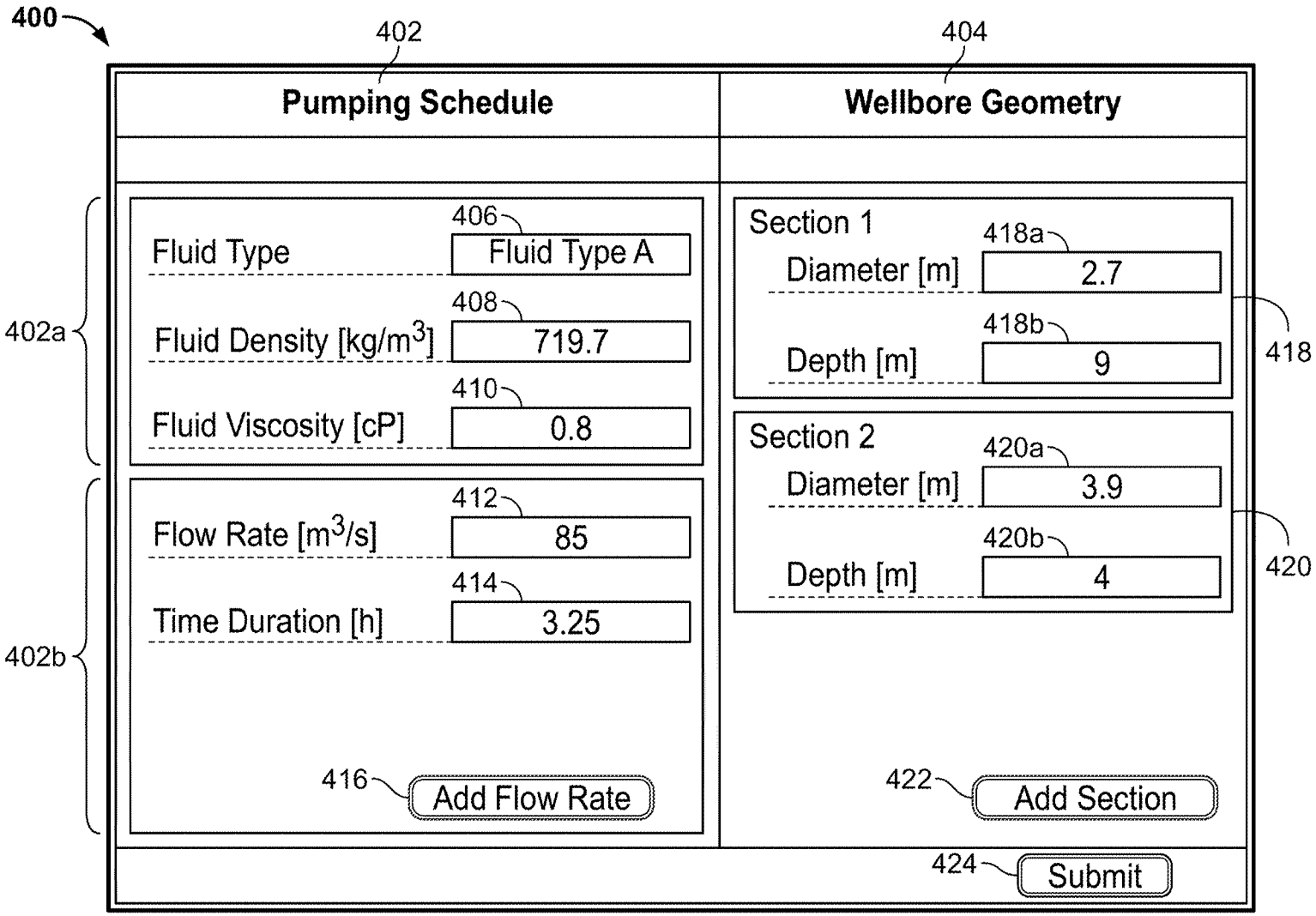
FIG. 4 is an example graphical user interface designed for data input.

FIG. 4 is an example graphical user interface 400 that may be used to provide input data for the wellbore fluid flow model. The illustrated interface 400 includes a pumping schedule component 402, a wellbore geometry component 404 and multiple control buttons (416, 422 and 424).

The pumping schedule component 402 also includes a fluid characterization component 402*a* and flow characterization component 402*b*. The pumping schedule component 402 defines the settings associated with pumping a particular type of fluid into a wellbore. In some embodiments, a user interacting with the interface 400 can access element 406 to define and/or to select the fluid type. In some embodiments, the element 406 can be a drop-down list, which provides direct access to all types of fluids, which can be pumped through the wellbore (e.g., a fracturing or other completion fluid, a hydrocarbon production fluid, or otherwise). For example, the fluid type 406 can be selected from a database. In some embodiments, the element 406 allows the user to define a new type of fluid, for example one that is not included in the list. In some embodiments, after the user selects the fluid type 406, the system (e.g., system 102 in FIG. 1) automatically retrieves the corresponding fluid properties from a database (e.g., stored in memory 132 in FIG. 1).

The system (e.g., system 102 in FIG. 1) can automatically display fluid density 408, fluid viscosity 410 and/or other fluid properties in the interface 400. In some embodiments a user interacting with the interface 400 can define and/or modify the fluid properties (408 and 410) displayed by the interface 400. The flow rate component 402*b* can include multiple elements allowing the user to define the velocity or the flow rate 412, the frequency and/or the time duration 414 and/or other flow rate variables. A control button 416, incorporated in the pumping schedule component 402, allows a user to add more flow rates.

The wellbore geometry component 404 includes multiple sets of components corresponding to different sections of the wellbore (e.g., Section 1: 418, Section 2: 420, and others). The wellbore geometry component 404 defines the geometrical characteristics of the wellbore that can influence the fluid flow through the wellbore. In some embodiments, the geometrical parameters within the wellbore geometry component 404 will be divided per sections (e.g., 418, 420, etc.), allowing accurate representation of the variation of a wellbore geometry. Each section includes a set of parameters, which can be defined by the user, such as diameter (418*a* and 420*a*), depth (418*b* and 420*b*) and/or other geometrical parameters. A control button 422, incorporated in the wellbore geometry component 404, allows a user to add further sections. In some embodiments, the interface 400 can include a button 424 to allow a user to activate the successive step of the fluid flow model.

Figure 5:
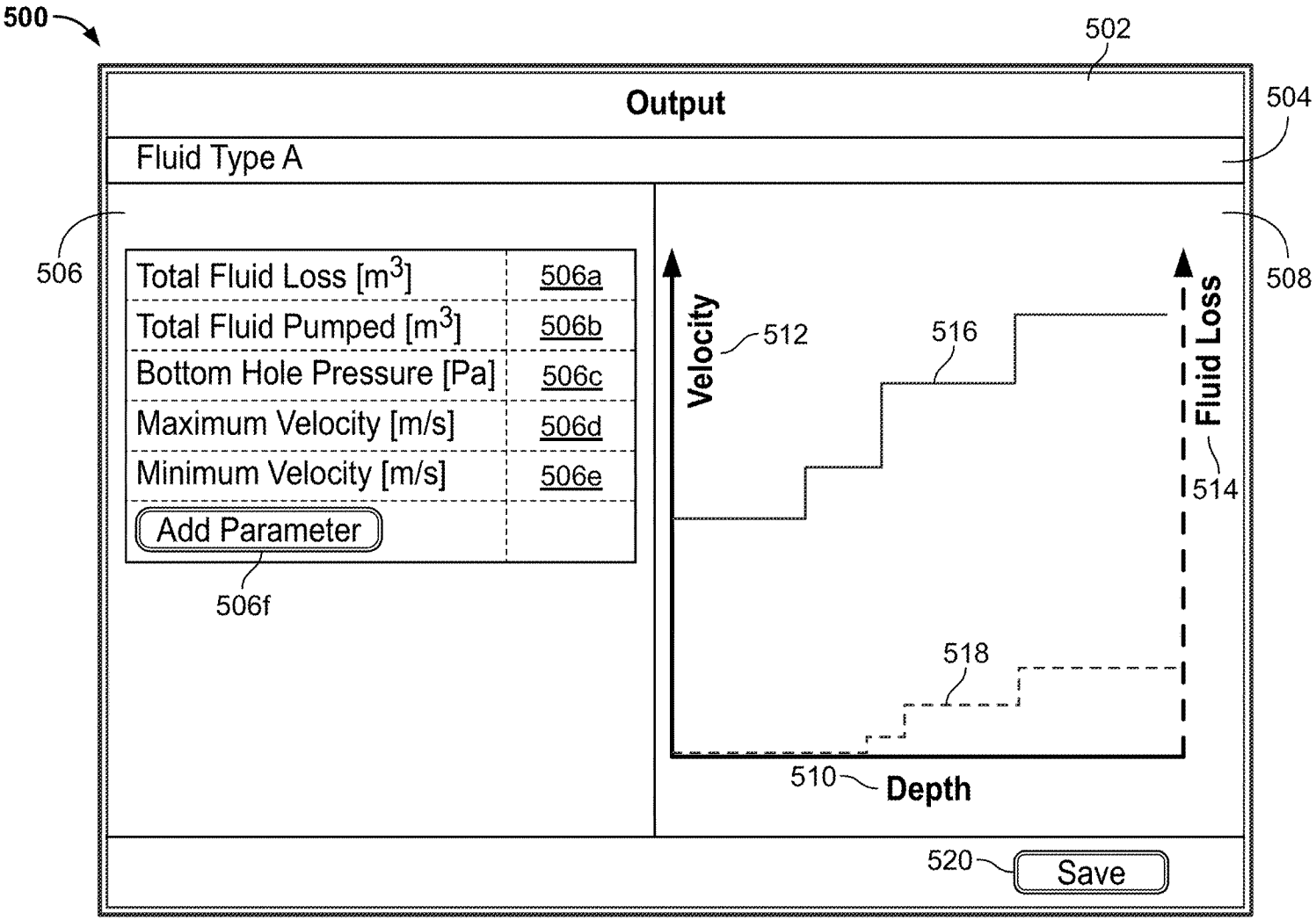
FIG. 5 is an example graphical user interface designed to display data output.

Referring to FIG. 5, the interface 500 is an example display of the wellbore fluid flow model output. The illustrated interface 500 includes static text labels, such as the title 502 of the interface 500 and/or an identifier of the results 504, a numerical component 506, a plot component 508 and a control button 520.

In some embodiments the numerical component 506 can be a tabulated display of the results of the fluid flow model, including but not limited to: total fluid loss 506*a*, total fluid pumped 506*b*, bottom hole pressure 506*c*, maximum velocity 506*d*, minimum velocity 506*e* and/or others. In some embodiments a user can access the displayed results to select the display of a different parameter or to select different units. The numerical component 506 can also include a control button 506*f* to add additional results for display.

The plot component 508, can display the results of wellbore fluid flow model. The X-axis 510 can be depth and it can cover one or multiple sections of the wellbore. The plot can have multiple Y-axes, such as velocity 512 and fluid loss 514. In some embodiments, a user can access (for example, with a selection) the label of an axis (510, 512, and/or 514) to select a different variable for display. As illustrated, multiple curves (516 and 518) are plotted, corresponding to the selected axes. In some embodiments the interface 500 can include a control button, to allow the user to store the displayed results of the wellbore fluid flow model.

A number of embodiments have been described. Nevertheless, it will be understood that various modifications may be made. For example, other methods described herein besides or in addition to that illustrated in FIG. 2 may be performed. Further, the illustrated steps of method 300 (FIG. 3) may be performed in different orders, either concurrently or serially. Further, steps may be performed in addition to those illustrated in method 300 (FIG. 3), and some steps illustrated in method 300 (FIG. 3) may be omitted without deviating from the present disclosure. Accordingly, other embodiments are within the scope of the following claims.

What is claimed is:

1. A method performed with a computing system for modeling fluid flow within a wellbore, the method comprising:

identifying, with the computing system, an input characterizing a fluid flow through a wellbore;

identifying, with the computing system, an input characterizing a geometry of the wellbore;

generating, with the computing system, a model of the fluid flow through the wellbore based on the inputs characterizing the fluid flow and the geometry of the wellbore, the model comprising at least one discontinuity corresponding to an opening in a casing that facilitates fluid communication between an interior of the casing and a fluid reservoir in the wellbore exterior to the casing, wherein the opening comprises a perforation of a plurality of perforations through the casing;

simulating, with the computing system, a stimulation treatment for the fluid flow through the wellbore based on evaluating the model with a numerical method that:

resolves the discontinuity by determining fluid flow conditions at a first boundary location node of the model and a second boundary location node of the model, the first and second boundary location nodes incorporated in the model proximate the discontinuity, with the first boundary location node upstream and adjacent to the discontinuity in the model, and the second boundary location node downstream and adjacent to the discontinuity in the model; and determines a mass flow rate of the fluid that flows through the plurality of perforations based, at least in part, on a respective size of each of the plurality of perforations, a density of the fluid, and a pressure difference between a wellbore pressure and a reservoir pressure in a subterranean zone; and preparing, based on the fluid flow conditions determined with the numerical method, an output associated with the simulated fluid flow through the wellbore for display to a user.

2. The method of claim 1, wherein the numerical method comprises a discontinuous Galerkin numerical method.

3. The method of claim 2, wherein simulating, with the computing system, the fluid flow through the wellbore based on evaluating the model with a numerical method comprises:

discretizing a conservation of mass equation; and applying a penalty term to the discretized conservation of mass equation based on a divergence of a fluid velocity of the fluid flow in the wellbore.

4. The method of claim 3, wherein the penalty term comprises the equation:

$$\nabla\cdot u-(\epsilon)^*(\nabla\cdot(\nabla_p-\rho g))=0,$$

where u is fluid momentum, ρ is the density of the fluid, ϵ is a penalty parameter, p is pressure of the fluid, and g is acceleration due to the force of gravity.

5. The method of claim 1, wherein determining a mass flow rate of the fluid that flows through the plurality of perforations of the wellbore based, at least in part, on a respective area of each of the plurality of perforations, a density of the fluid, and a pressure difference between a wellbore pressure and a reservoir pressure in a subterranean zone comprises solving the equation:

$$\dot{M}_D=C_D A_D N_D\sqrt{\rho^*(P_W-P_R-P_f)},$$

where $\dot{M}_D$ is the mass flow rate of the fluid that flows through the plurality of perforations of the wellbore, $C_D$ is a discharge coefficient, $A_D$ is a discontinuity area, ρ is the density of the fluid, $P_W$ is the wellbore pressure, $P_R$ is the reservoir pressure in the subterranean zone, and $P_f$ is a friction pressure.

6. The method of claim 1, wherein simulating, with the computing system, the fluid flow through the wellbore based on evaluating the model with a numerical method comprises:

determining a fluid pressure and a fluid velocity of the fluid flow at the plurality of perforations.

7. The method of claim 1, wherein generating, with the computing system, a model of the fluid flow through the wellbore based on the inputs characterizing the fluid flow and the geometry of the wellbore comprises:

generating a one-dimensional mesh model of the wellbore based on the inputs characterizing the fluid flow and the geometry of the wellbore.

8. The method of claim 1, wherein the input characterizing the geometry of the wellbore comprises at least one of a tubular diameter, a depth, and a location of the opening, and the input characterizing a fluid flow comprises one of:

a pumping schedule that defines a fluid volumetric flow rate over time, a fluid density, and a fluid viscosity circulated from a terranean surface into the wellbore, or a production schedule that defines a fluid volumetric flow rate over time, a fluid density, and a fluid viscosity produced from a subterranean zone to the terranean surface.

9. The method of claim 1, wherein the output comprises a bottom hole pressure and an amount of the fluid flowing through one or more of the plurality of perforations.

10. A non-transitory computer storage medium encoded with a computer program, the program comprising instructions that when executed by one or more computers cause the one or more computers to perform operations comprising:

identifying an input characterizing a fluid flow through a wellbore;

identifying an input characterizing a geometry of the wellbore;

generating a model of the fluid flow through the wellbore based on the inputs characterizing the fluid flow and the geometry of the wellbore, the model comprising at least one discontinuity corresponding to an opening in a casing that facilitates fluid communication between an interior of the casing and a fluid reservoir in the wellbore exterior to the casing, wherein the opening comprises a perforation of a plurality of perforations through the casing;

simulating a stimulation treatment for the fluid flow through the wellbore based on evaluating the model with a numerical method that:

resolves the discontinuity by determining fluid flow conditions at a first boundary location node of the model and a second boundary location node of the model, the first and second boundary location nodes incorporated in the model proximate the discontinuity, with the first boundary location node upstream and adjacent to the discontinuity in the model, and the second boundary location node downstream and adjacent to the discontinuity in the model; and determines a mass flow rate of the fluid that flows through the plurality of perforations based, at least in part, on a respective size of each of the plurality of perforations, a density of the fluid, and a pressure difference between a wellbore pressure and a reservoir pressure in a subterranean region; and preparing, based on the fluid flow conditions determined with the numerical method, an output associated with the simulated fluid flow through the wellbore for display to a user.

11. The non-transitory computer storage medium of claim 10, wherein the numerical method comprises a discontinuous Galerkin numerical method.

12. The non-transitory computer storage medium of claim 11, wherein simulating, with the computing system, the fluid flow through the wellbore based on evaluating the model with a numerical method comprises:

discretizing a conservation of mass equation; and applying a penalty term to the discretized conservation of mass equation based on a divergence of a fluid velocity of the fluid flow in the wellbore.

13. The non-transitory computer storage medium of claim 12, wherein the penalty term comprises the equation:

$$\nabla \cdot u-(\epsilon)*(\nabla \cdot (\nabla_p-\rho g))=0,$$

where u is fluid momentum, ρ is the density of the fluid, ϵ is a penalty parameter, p is pressure of the fluid, and g is acceleration due to the force of gravity.

14. The non-transitory computer storage medium of claim 10, wherein determining a mass flow rate of the fluid that flows through the plurality of perforations of the wellbore based, at least in part, on a respective area of each of the plurality of perforations, a density of the fluid, and a pressure difference between a wellbore pressure and a reservoir pressure in a subterranean zone comprises solving the equation:

$$\dot{M}_D=C_D A_D N_D \sqrt{\rho*(P_W-P_R-P_f)},$$

where $\dot{M}_D$ is the mass flow rate of the fluid that flows through the plurality of perforations of the wellbore, $C_D$ is a discharge coefficient, $A_D$ is a discontinuity area, ρ is the density of the fluid, $P_W$ is the wellbore pressure, $P_R$ is the reservoir pressure in the subterranean zone, and $P_f$ is a friction pressure.

15. The non-transitory computer storage medium of claim 10, wherein simulating, with the computing system, the fluid flow through the wellbore based on evaluating the model with a numerical method comprises:

determining a fluid pressure and a fluid velocity of the fluid flow at the plurality of perforations.

16. The non-transitory computer storage medium of claim 10, wherein generating a model of the fluid flow through the wellbore based on the inputs characterizing the fluid flow and the geometry of the wellbore comprises:

generating a one-dimensional mesh model of the wellbore based on the inputs characterizing the fluid flow and the geometry of the wellbore.

17. The non-transitory computer storage medium of claim 10, wherein the input characterizing the geometry of the wellbore comprises at least one of a tubular diameter, a depth, and a location of the opening, and the input characterizing a fluid flow comprises one of:

a pumping schedule that defines a fluid volumetric flow rate over time, a fluid density, and a fluid viscosity circulated from a terranean surface into the wellbore, or a production schedule that defines a fluid volumetric flow rate over time, a fluid density, and a fluid viscosity produced from a subterranean zone to the terranean surface.

18. The non-transitory computer storage medium of claim 10, wherein the output comprises a bottom hole pressure and an amount of the fluid flowing through one or more of the plurality of perforations.

19. A system of one or more computers configured to perform operations comprising:

identifying an input characterizing a fluid flow through a wellbore;

identifying an input characterizing a geometry of the wellbore;

generating a model of the fluid flow through the wellbore based on the inputs characterizing the fluid flow and the geometry of the wellbore, the model comprising at least one discontinuity corresponding to an opening in a casing that facilitates fluid communication between an interior of the casing and a fluid reservoir in the wellbore exterior to the casing, wherein the opening comprises a perforation of a plurality of perforations through the casing;

simulating a stimulation treatment for the fluid flow through the wellbore based on evaluating the model with a numerical method that:

resolves the discontinuity by-determining fluid flow conditions at a first boundary location node of the model and a second boundary location node of the model, the first and second boundary location nodes incorporated in the model proximate the discontinuity, with the first boundary location node upstream and adjacent to the discontinuity in the model, and the second boundary location node downstream and adjacent to the discontinuity in the model; and determines a mass flow rate of the fluid that flows through the plurality of perforations based, at least in part, on a respective size of each of the plurality of perforations, a density of the fluid, and a pressure difference between a wellbore pressure and a reservoir pressure in a subterranean region; and preparing, based on the fluid flow conditions determined with the numerical method, an output associated with the simulated fluid flow through the wellbore for display to a user.

20. The system of claim 19, wherein the numerical method comprises a discontinuous Galerkin numerical method.

21. The system of claim 20, wherein simulating, with the computing system, the fluid flow through the wellbore based on evaluating the model with a numerical method comprises:

discretizing a conservation of mass equation; and applying a penalty term to the discretized conservation of mass equation based on a divergence of a fluid velocity of the fluid flow in the wellbore.

22. The system of claim 21, wherein the penalty term comprises the equation:

$$\nabla \cdot u-(\epsilon)*(\nabla \cdot (\nabla_p-\rho g))=0,$$

where u is fluid momentum, ρ is the density of the fluid, ϵ is a penalty parameter, p is pressure of the fluid, and g is acceleration due to the force of gravity.

23. The system of claim 19, wherein determining a mass flow rate of the fluid that flows through the plurality of perforations of the wellbore based, at least in part, on a respective area of each of the plurality of perforations, a density of the fluid, and a pressure difference between a wellbore pressure and a reservoir pressure in a subterranean zone comprises solving the equation:

$$\dot{M}_D \times C_D A_D N_D \sqrt{\rho*(P_W-P_R-P_f)},$$

where $\dot{M}_D$ is the mass flow rate of the fluid that flows through the plurality of perforations of the wellbore, $C_D$ is a discharge coefficient, $A_D$ is a discontinuity area, ρ is the density of the fluid, $P_W$ is the wellbore pressure, $P_R$ is the reservoir pressure in the subterranean zone, and $P_f$ is a friction pressure.

24. The system of claim 19, wherein simulating, with the computing system, the fluid flow through the wellbore based on evaluating the model with a numerical method comprises:

determining a fluid pressure and a fluid velocity of the fluid flow at the plurality of perforations.

25. The system of claim 19, wherein generating, with the computing system, a model of the fluid flow through the wellbore based on the inputs characterizing the fluid flow and the geometry of the wellbore comprises:

generating a one-dimensional mesh model of the wellbore based on the inputs characterizing the fluid flow and the geometry of the wellbore.

26. The system of claim 19, wherein the input characterizing the geometry of the wellbore comprises at least one of a tubular diameter, a depth, and a location of the opening, and the input characterizing a fluid flow comprises one of:

a pumping schedule that defines a fluid volumetric flow rate over time, a fluid density, and a fluid viscosity circulated from a terranean surface into the wellbore, or a production schedule that defines a fluid volumetric flow rate over time, a fluid density, and a fluid viscosity produced from a subterranean zone to the terranean surface.

27. The system of claim 19, wherein the output comprises a bottom hole pressure and an amount of the fluid flowing through one or more of the plurality of perforations.

28. The method of claim 1, wherein simulating the fluid flow through the wellbore comprises setting a pressure value at the first boundary location node equal to a pressure value at the second boundary location node.

29. The method of claim 28, wherein simulating the fluid flow through the wellbore further comprises determining a velocity value at the second boundary location node based at least in part on the equal pressure values at the first and second boundary location nodes.

30. The method of claim 1, wherein the opening comprises at least one of a perforation and a fracture in the casing.

31. The method of claim 1, wherein the model comprises an array of distributed nodes including the first and second nodes, and wherein the first node comprises the closest node in the array on an upstream side of the discontinuity and second node comprises the closest node in the array on a downstream side of the discontinuity.

* * * * *